US008105220B2

(12) United States Patent
Schultheisz

(10) Patent No.: US 8,105,220 B2
(45) Date of Patent: Jan. 31, 2012

(54) TOY DEVICE FOR COORDINATION AND MOVEMENT SKILL DEVELOPMENT

(76) Inventor: Judit Schultheisz, Budapest (HU)

( * ) Notice: Subject to any disclaimer, the term of this patent is extended or adjusted under 35 U.S.C. 154(b) by 94 days.

(21) Appl. No.: 12/520,130

(22) PCT Filed: Dec. 21, 2007

(86) PCT No.: PCT/HU2007/000129

§ 371 (c)(1),
(2), (4) Date: Jun. 19, 2009

(87) PCT Pub. No.: WO2008/075119

PCT Pub. Date: Jun. 26, 2008

(65) Prior Publication Data

US 2010/0022369 A1 Jan. 28, 2010

(30) Foreign Application Priority Data

Dec. 21, 2006 (HU) ..... 0600940

(51) Int. Cl.
*A63B 22/14* (2006.01)
*A63G 1/12* (2006.01)

(52) U.S. Cl. ..... 482/146; 472/14

(58) Field of Classification Search ..... 482/51, 482/78, 66–69; 472/25, 115
See application file for complete search history.

(56) References Cited

U.S. PATENT DOCUMENTS 3,041,070 A * 6/1962 Kerstein ..... 472/25
3,380,735 A * 4/1968 Rigby ..... 482/18
3,586,321 A * 6/1971 Gehrke et al. ..... 482/146
4,801,140 A 1/1989 Bergeron
5,951,403 A * 9/1999 Trzos ..... 472/25
6,422,983 B1 7/2002 Weck
6,702,726 B2 * 3/2004 Lin ..... 482/148
2005/0009677 A1 1/2005 Yang
2009/0286656 A1 * 11/2009 Okamoto ..... 482/78

FOREIGN PATENT DOCUMENTS

HU W09829171 A 7/1998

OTHER PUBLICATIONS

European Patent Office, International Search Report, Mar. 19, 2008, P.B. 5818 Patentlaan 2, NL—2280 HV Rijswij.

* cited by examiner

*Primary Examiner* — Fenn Mathew
(74) *Attorney, Agent, or Firm* — Louis Ventre, Jr.

(57) ABSTRACT

Toy device (1) for coordination and motion skill development having a hollow spherical-segment or spherical-cap shape, it comprises an alternate-geometry portion (3) arranged in an annular fashion in the region of the edge of the spherical-cap portion (2) thereof. Preferably the spherical-cap portion (2) thereof is a hemisphere surface, that is, the spherical cap is produced by intersecting the sphere with a plane passing through the centre of the sphere, and a cylindrical portion (4) is connected to the spherical-cap portion (2) thereof along the circumference of the spherical cap, with the toy device comprising an annular side flange (6) extending outward from the axis of symmetry (5) of the sphere, with the side flange (6) being arranged in a plane perpendicular to the axis of symmetry (5) of the sphere, and the side flange (6) having an endless wavy shape (7) configuration.

5 Claims, 1 Drawing Sheet

TOY DEVICE FOR COORDINATION AND MOVEMENT SKILL DEVELOPMENT

Figure 1:
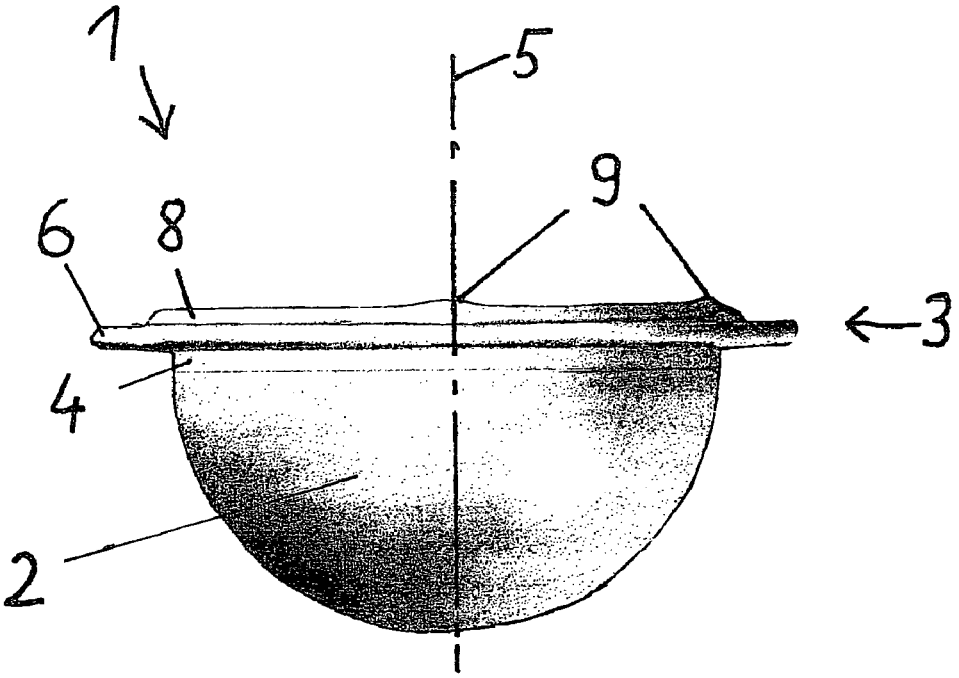

The object of the invention is a toy device for coordination and movement skill development that is useful for children and adults alike in carrying out special movement types that are both entertaining and healthy.

In our modern age, bodily motion has assumed a new, different role. Physical strength and dexterity are no longer necessary skills for survival and for preserving the race, with the role of these skills having diminished in human work tasks as civilization advanced. Nowadays, different games, sports and leisure activities are targeted towards answering—in an organized way, applying specific devices—the strong drive for motion so characteristic of children (that is also necessary for their development) and also the need for motion activities on the part of adults with inactive lifestyles.

Movement skills and coordination of children improves through playing and exploring their environment, by setting themselves—and accomplishing—more and more difficult aims. Meanwhile, fostered by their sense of achievement and the multiple repetition of activities, their inquisitiveness also improves. Learning and development may be aided by providing the child with objects and devices that put to test his particular skills and abilities. In case our aim is the rehabilitation of physically handicapped children and/or children with complex congenital developmental defects, the role of devices dedicated to practicing particular movements and positions becomes crucial.

In rehabilitating children with central nervous system disorders a very significant role is played by therapeutic methods involving the improvement of the sense of balance. The need for a movement skill development device that helps carrying out balance and movement exercises of different type and difficulty, providing multiple functions preferably in a cost-efficient and space-saving way arose during my activities in child rehabilitation. Thus, I have developed a solution that can be utilized in multiple different ways with the application of different, variable portions.

This invention, disclosed in patent descriptions HU 216 737 (WO 9829171, EP 1011832 B2), consists of a rigid globe surface divided into combinable portions, and of additional parts attached to it, which, apart from accomplishing the inventive objective can be applied for executing movement types that previously were to impossible carry out.

In order to execute exercises successfully it is desirable that children can use/play with the device at home, in a family setting, either helped by parents or on their own. It would be expedient if the device could be used for exercising also by the parents and brothers/sisters of the primary user because of the inspiring, beneficial influence their personal example and playing together have on the child's health and bodily development.

Thus, the need for improving the existing device arose in day-to-day use, in order to extend the useability of the device to the entire family by providing an aesthetically pleasing, safe and easily useable toy device. Therefore, I set the objective of accomplishing the above goals.

The present invention is based on the recognition that the most important constituent of the coordination and movement skill development device consisting of interconnectible elements is the globe (spherical) surface, characteristics of which can be improved uncompromisingly conforming to usage requirements in case other elements of the complex system are left out.

The invention is therefore a toy device for coordination and motion skill development having a hollow spherical-segment or spherical-cap shape, which is characterised by that it comprises an alternate-geometry surface portion arranged in an annular fashion in the region of the edge of the spherical-cap thereof.

According to a preferred embodiment of the inventive toy device the spherical-cap portion is a hemisphere surface, that is, the spherical cap is produced by intersecting the sphere with a plane passing through the centre of the sphere.

According to another preferred embodiment of the inventive toy device, a cylindrical portion is connected to the spherical-cap portion thereof along the circumference of the spherical cap, with the toy device comprising an annular side flange extending outward from the axis of symmetry of the sphere, with the side flange being arranged in a plane perpendicular to the axis of symmetry of the sphere, and the side flange having an endless wavy shape configuration.

According to a further preferred embodiment of the invention the toy device comprises an upper flange disposed along the circumference thereof in a plane perpendicular to the symmetry axis of the sphere, with at least one, but preferably two projections protruding from its plane, being disposed on the upper flange.

A still further preferred embodiment of the inventive toy device is characterised by that the projections disposed on the upper flange are located next to a wave trough of the side flange. Another preferred embodiment of the inventive toy device is characterised by that the projections, the side flange, and the inner surface of the toy device are lined with a continuous lining flexible to the touch, and according to yet another preferred embodiment the projections and/or the side flange are implemented as a grip (independent of the lining), expediently as an anti-slip surface.

Figure 2:
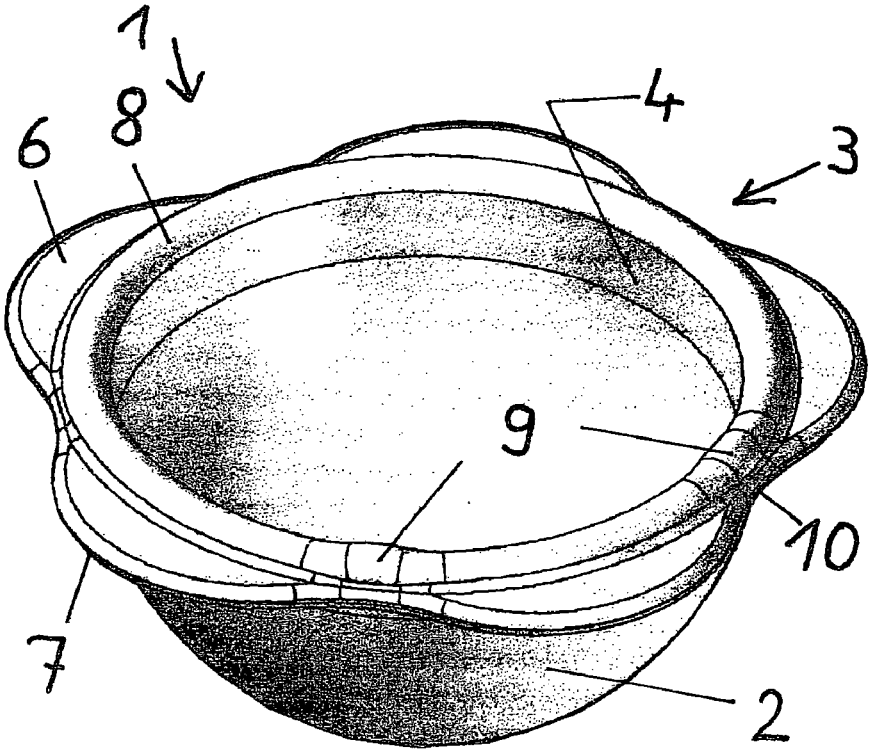

In the following the invention is described in detail by referring to the accompanying drawings, where FIG. 1 shows the side view of a conceivable embodiment of the invention, and FIG. 2 shows the axonometric view of the same embodiment of the invention.

The overall shape of the toy device 1 shown in the drawings is determined by the spherical-cap portion 2

In FIG. 2 we can see into the interior of this spherical-cap portion 2. Because younger or older children sit, kneel or lie down into the spherical-cap portion 2 of the toy device 1 in the position shown in the drawing, the device should expediently have a substantially hemispherical shape with a sufficiently large diameter. Safety and comfort of use is provided by the configuration of the alternate-geometry portion 3. The surface of the device is smooth, all edges and comers are rounded off. When a child user turns the toy device 1 upside down and cuddles under it, the toy device 1 is supported and lifted—to the extent that a sufficient amount of air and light can get into the "den"—by projections 9 extending from upper flange 8.

Adults can only fit into the toy device 1 in a sitting position, but it is equally important for them that the spherical-cap portion 2 be sufficiently large. In this case, however, the configuration of the alternate-geometry portion 3 becomes important. Adults may rest their legs on the upper flange 8 touching it with the back of the knees, most comfortably at the projections 9 disposed on the upper flange 8 beside the wave troughs 10 of the side flange 6 which preferably has a wavy shape 7 such that the side flange does not prevent users from sticking legs out. The part of upper flange 8 opposite the projections 9 may be used for reclining on it, while the lateral portions thereof are suitable as arm rests or for gripping the device. The cylindrical portion 4 is added to provide that the upper flange 8 (disposed expediently at a plane perpendicular to the axis of symmetry 5 of the device) is located at a height convenient for performing the above mentioned actions. The toy device 1 is sufficiently stiff in this position as well as with the spherical-cap portion 2 turned upwards, its deformation being reduced also by the side flange 6. The side flange 6 further performs the function of a grip, because the inventive toy device 1—manufactured from modern materials such as PU foam—is lightweight enough to be easily lifted by hand. In some cases, the toy device 1 may also be conveniently held by the projections 9, so it may be expedient to design the surface geometry of the device accordingly. Applying up-to-date manufacturing technology and materials, the inventive toy device 1 can be produced at low cost and thus may be made available for a wide range of users.

Therefore, such a coloured, washable toy device with semi-rigid side walls and slightly more rigid bottom can become part of one's everyday living space as a piece of furniture.

The chief purpose of the inventive toy device is to provide a possibility for children and adults alike to lie down, sit, or stand in it, and that in all of these postures users may rock or spin in the hemispherical device easily, with little resistance.

Through its stimulating effect on the balance organ the toy device may be advantageously applied for improving coordination and for balancing games.

It is especially applicable as a cradle for babies, helping provide feedback for perceiving the outcome of early spontaneous movements. Through the regular use of the device the nervous system receives sustained positive stimulation, improving perception skills and resulting in a mentally open, alert state, intensively affecting the development of balancing skills.

An important effect of using the inventive toy device by adults is the stimulation of the slight movement of the muscles of the back both in a standing and sitting position. This is all the more important because usually only the gross movements of the major trunk muscles are utilized. The invention, however, provides stimulation for rarely used muscles through provoked balancing action, and thus it helps bring about a relaxed, near-equilibrium muscle state to alleviate the feeling of fatigue.

LIST OF REFERENCE NUMERALS

1 toy device
2 spherical-cap portion
3 alternate-geometry portion
4 cylindrical portion
5 axis of symmetry
6 side flange
7 wavy shape
8 upper flange
9 projection
10 wave trough

The invention claimed is:

1. Toy device for coordination and motion skill development comprising:

a hollow spherical-cap portion defined by an axis of symmetry and an edge, wherein the hollow spherical-cap portion comprises an inner surface, and wherein the hollow spherical-cap portion is configured to at least partially contain a person within;

a cylindrical portion connected to the edge of the hollow spherical-cap portion;

an annular side flange extending outwardly from the cylindrical portion and configured with a sinusoidal shape with troughs adapted to allow a user's legs to stick out;

an upper flange adapted to sit atop the cylindrical portion, positioned immediately above the annular side flange, and extending outwardly in a plane perpendicular to the axis of symmetry of the toy device; and, projections disposed on the upper flange inward of the troughs, the projections configured to support and lift the toy device off a floor to permit entry of air and light when the toy device is turned over; and further configured to allow a user to rest user's legs on the upper flange touching the projections with backs of user's knees and user's legs extending into the troughs.

2. The toy device according to claim 1, wherein the hollow spherical-cap portion is further defined by a hemisphere surface produced by intersecting a sphere with a plane passing through the centre of the sphere.

3. The toy device according to claim 1 further comprising a continuous, flexible lining on the projections, the annular side flange, and the inner surface of the hollow spherical-cap portion.

4. The toy device according to claim 1, wherein the projection is configured as a hand grip with an anti-slip surface.

5. The toy device according to claim 1, wherein the annular side flange is configured as a hand grip with an anti-slip surface.

* * * * *